US005799825A

United States Patent [19]

Dillman

[11] Patent Number: 5,799,825

[45] Date of Patent: Sep. 1, 1998

[54] GATE SEAL SYSTEM

[75] Inventor: Bruce A. Dillman, Cape Coral, Fla.

[73] Assignee: Marquette Leasing, Inc., Prairie Du Chien, Wis.

[21] Appl. No.: 614,866

[22] Filed: Mar. 13, 1996

[51] Int. Cl.[6] ..... B67B 7/00

[52] U.S. Cl. ..... 222/1; 222/185.1; 222/504; 137/613; 137/614.21; 251/158

[58] Field of Search ..... 222/504, 545, 222/185.1, 1; 137/613, 614.21; 251/158, 187

[56] References Cited

U.S. PATENT DOCUMENTS

| | | | |
|---|---|---|---|
| 1,746,743 | 2/1930 | Ross . | |
| 3,182,859 | 5/1965 | Harris et al. . | |
| 3,301,441 | 1/1967 | Werner et al. . | |
| 3,305,138 | 2/1967 | Plumb . | |
| 3,472,399 | 10/1969 | Felts . | |
| 3,532,252 | 10/1970 | Brock . | |
| 3,856,275 | 12/1974 | Dydzyk . | |
| 3,949,907 | 4/1976 | Mize . | |
| 4,165,184 | 8/1979 | Schlarmann . | |
| 4,306,828 | 12/1981 | Legille et al. | 251/158 X |
| 4,318,619 | 3/1982 | Schlarmann . | |
| 4,326,750 | 4/1982 | Rosenbaum . | |
| 4,465,419 | 8/1984 | Stratmann et al. . | |
| 4,512,703 | 4/1985 | Lepley . | |
| 4,747,577 | 5/1988 | Dimock | 251/158 |
| 4,957,221 | 9/1990 | Murray . | |
| 5,199,612 | 4/1993 | Raque | 222/504 X |
| 5,411,174 | 5/1995 | Braun et al. | 222/504 X |

*Primary Examiner*—Gregory L. Huson
*Attorney, Agent, or Firm*—Wallenstein & Wagner, Ltd.

[57] ABSTRACT

A material storing and dispensing assembly for storing and discharging hot asphalt material, comprising a vertically-extending vessel having a generally cylindrical shape and a top opening for receiving material, a dispensing cone positioned in the vessel and opposed to the top opening, the dispensing cone having a discharge opening at a distal end for discharging material from the vessel, a first gate enclosed within a gate weldment and adapted for engagement with the discharge opening slidable between one of an open position for releasing material from the vessel through the discharge opening and a closed position for retaining material within the vessel, a second gate having a sealing face adapted for effectively sealing the discharge opening by rotating the second gate from a vertical storage position into a horizontal closed position, a third gate adapted for further cooperating with the first and second gates and slidable between one of an open position for releasing material from the vessel and a closed position for retaining material within the vessel.

29 Claims, 5 Drawing Sheets

GATE SEAL SYSTEM

DESCRIPTION

TECHNICAL FIELD

The present invention relates to the field of asphalt storage. More specifically, the present invention relates to a gate system which effectively seals a storage silo against intrusion by ambient air.

BACKGROUND OF THE INVENTION

Asphalt mix is typically stored in a silo. The use of silo storage is well-known in the art. It is desirable to keep the silo airtight to prevent the asphalt mix in the silo from oxidizing by contact with outside air. Oxidation of the asphalt mix is undesirable. There have been many attempts to provide an airtight seal for the silo, with varying degrees of success. These include U.S. Pat. Nos. 5,318,199, 4,249,679, 3,820,687 and 3,834,595, which utilize fluids and other methods to provide an airtight seal. None of these previous attempts at sealing, however, provide the advantages of the present invention.

SUMMARY OF THE INVENTION

The present invention provides a material storing and dispensing assembly for storing and discharging hot asphalt material comprising a vertically-extending vessel having a generally cylindrical shape and a top opening for receiving material. A dispensing cone is positioned in the vessel, opposed to the top opening, and includes a discharge opening at a distal end for discharging material from the vessel. A first gate is enclosed within a gate weldment, and adapted for engagement with the discharge opening slidable between one of an open position for releasing material from the vessel through the discharge opening and a closed position for retaining material within the vessel. A second gate is provided, having a sealing face adapted for effectively sealing the discharge opening by rotating the second gate from a vertical storage position into a horizontal closed position. A third gate is provided and adapted for further cooperating with the first and second gates, the third gate being slidable between one of an open position for releasing material from the vessel and a closed position for retaining material within the vessel.

It is an object of the present invention to provide a discharge and storage assembly which permits an airtight seal to prevent oxidation of the asphalt. It is also an object of the present invention to provide a discharge and storage system which overcomes sealing and discharge problems associated with buildup of asphaltic residue on the top surface of the gates.

It is a further object of the present invention to provide a long term seal gate which the operator can easily inspect and clean, if necessary, prior to sealing the silo.

Other advantages and aspects of the invention will become apparent upon making reference to the specification, claims and drawings to follow.

DETAILED DESCRIPTION OF THE PREFERRED EMBODIMENT

Figure 1:
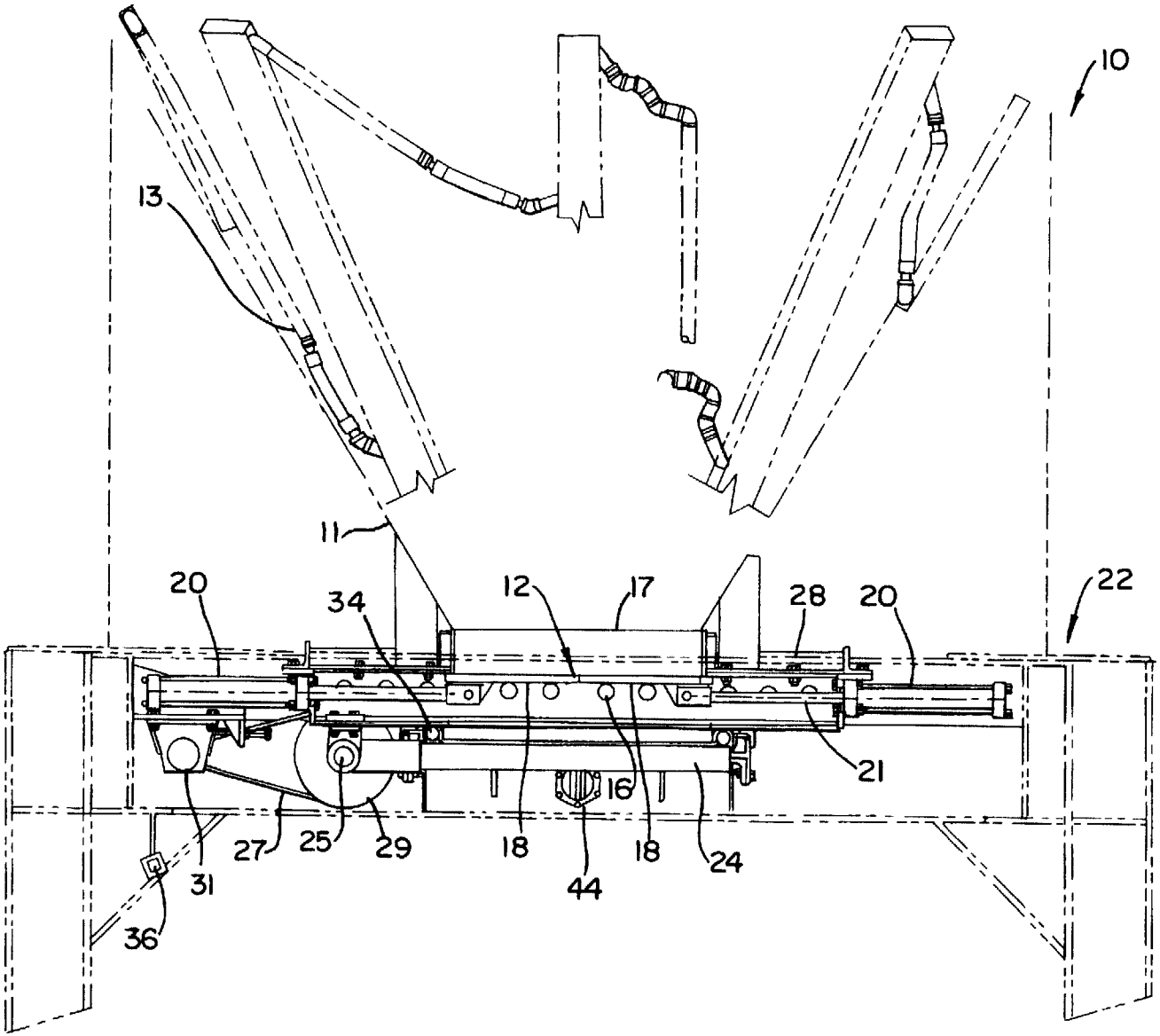
FIG. 1 is a side view of the gate system of the present invention in the closed position.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Referring to the Figures, FIG. 1 shows the storage and discharge assembly 10 of the present invention in the closed position. A vertically-extending silo 11 receives and stores asphalt. The silo 11 is outfitted with a hot oil jacket or electric strip heater 13 to heat the discharge area of the silo. The silo 11 has a top opening (not shown) for introducing asphalt mix to the silo 11, and a dispensing cone 17 having a discharge opening 14 located at the bottom of the silo 11.

Figure 2:
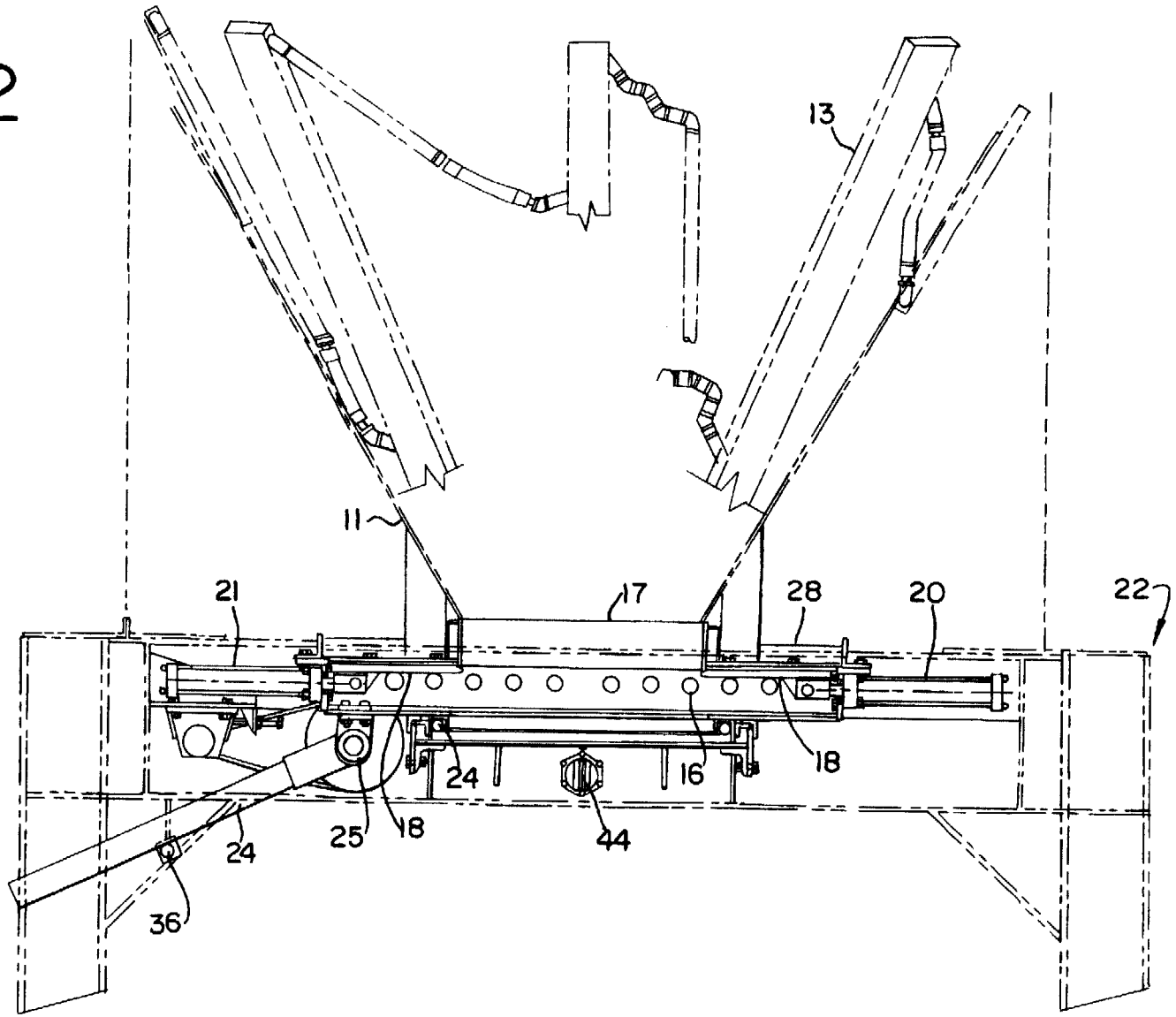
FIG. 2 is a side view of the gate system of the present invention in the dispensing position.
Figure 3:
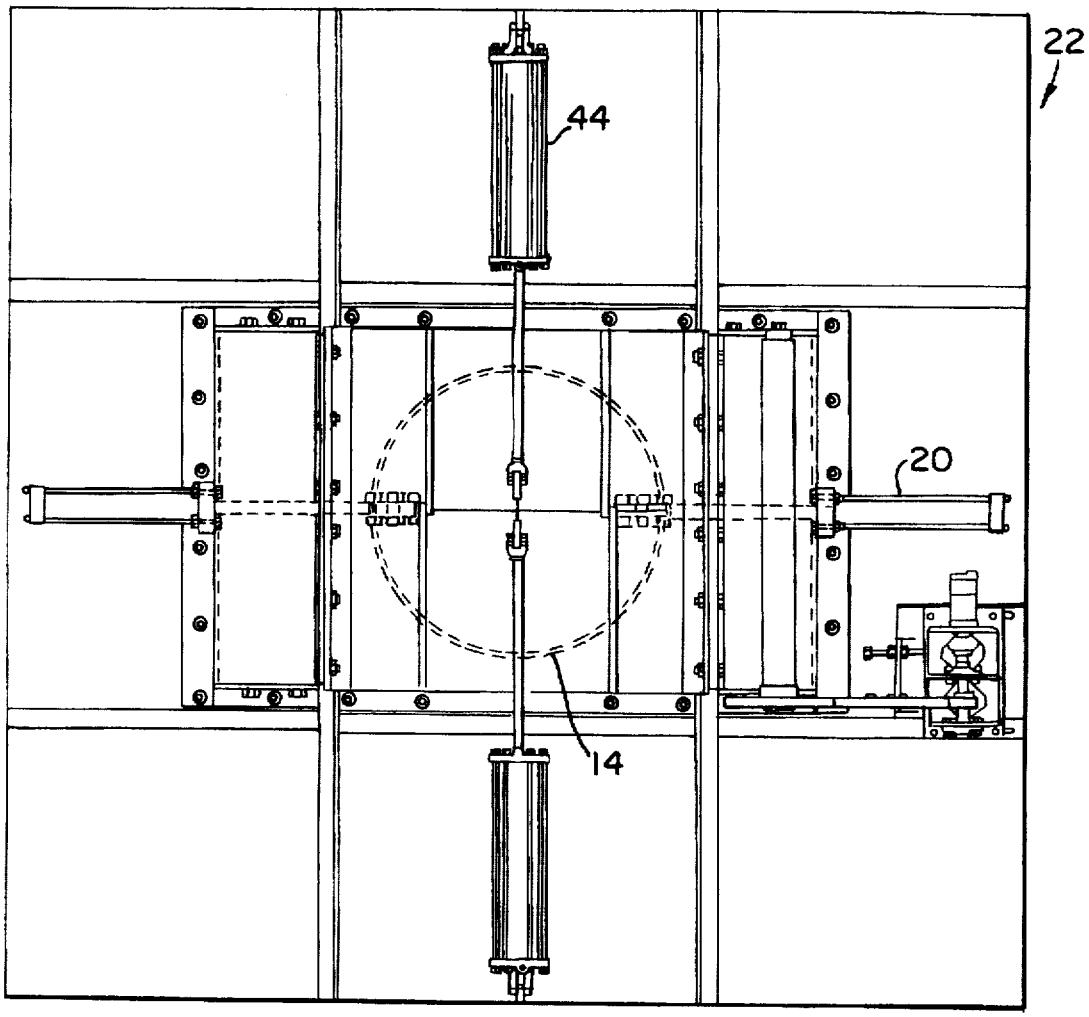
FIG. 3 is a bottom view of the gate system of the present invention.
Figure 4:
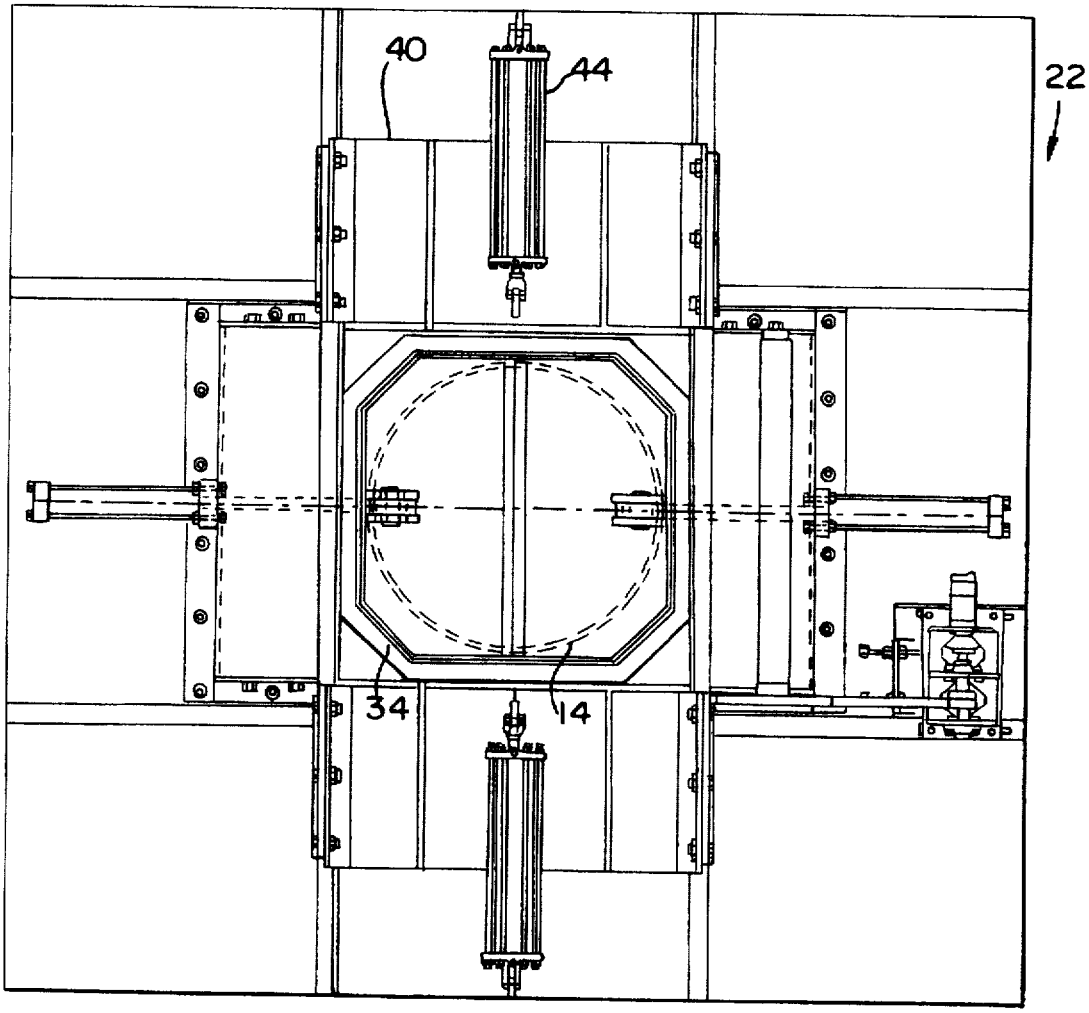
FIG. 4 is a bottom view of the gate system of the present invention in the dispensing position.

A first gate 12 is located at the discharge opening 14. The first gate 12 comprises two horizontal flat plates 18 which are supported by cam rollers 16 and propelled by hydraulic drive cylinders 20 through rods 21. The hydraulic drive cylinders 20 can be actuated by any conventional means, either automatically or manually. The cam rollers 16 are mounted into a weldment 22. The weldment 22 is attached to the discharge opening 14 of the silo 11 and surrounds the dispensing cone 17. The weldment 22 has a bottom opening 19 for dispensing asphalt mix. The sole purpose of the first gate 12 is to discharge contents of the silo 11 upon command into a dump truck or other receptacle. As shown in FIGS. 1 and 3, the plates 18 abut one another to close the discharge opening 14 of the silo 11. As shown in FIGS. 2 and 4, the plates 18 are separated in the open position to permit asphalt mix to flow from the silo 11. The first gate 12 is not designed to seal the bottom of the silo, nor is it designed to make the silo airtight.

A second gate 24 is encapsulated in weldment 22 designed to be sealed on the top with flanges 28. The second gate 24 comprises a plate which is rotatable along one edge about pin 25 which is attached to the underside of weldment 22. The second gate 24 is rotated by a belt 27, flywheel 29 and motor 31 which can be actuated by any conventional means. The second gate 24 is designed to provide a long term seal gate.

The discharge opening 14 of the weldment 22 contains an octagonal or circular-shaped area, which supports and aligns a sealing element 34. An octagonal-shaped area is shown in FIG. 4, but a circular area is preferred. The sealing element preferably comprises a rubber seal, preferably an O ring. The O ring 34 is approximately 1 ½inches in diameter. The hydraulically-operated second gate 24 is adapted to position itself snugly against the O ring 34 to prevent the flow of ambient air into the silo 11.

FIG. 2 shows the discharge and opening system 12 of the present invention in the open position, in which the plates 18 are separated to permit asphalt to fall through by the action of gravity. The second gate 24 is secured in a stored position by a safety latch 36. The latch 36 prevents the second gate 24 from accidentally rotating downward and contacting a dump truck or interfering with the discharge of the silo contents. The latch 36 automatically engages when the second gate 24 is rotated.

Figure 5:
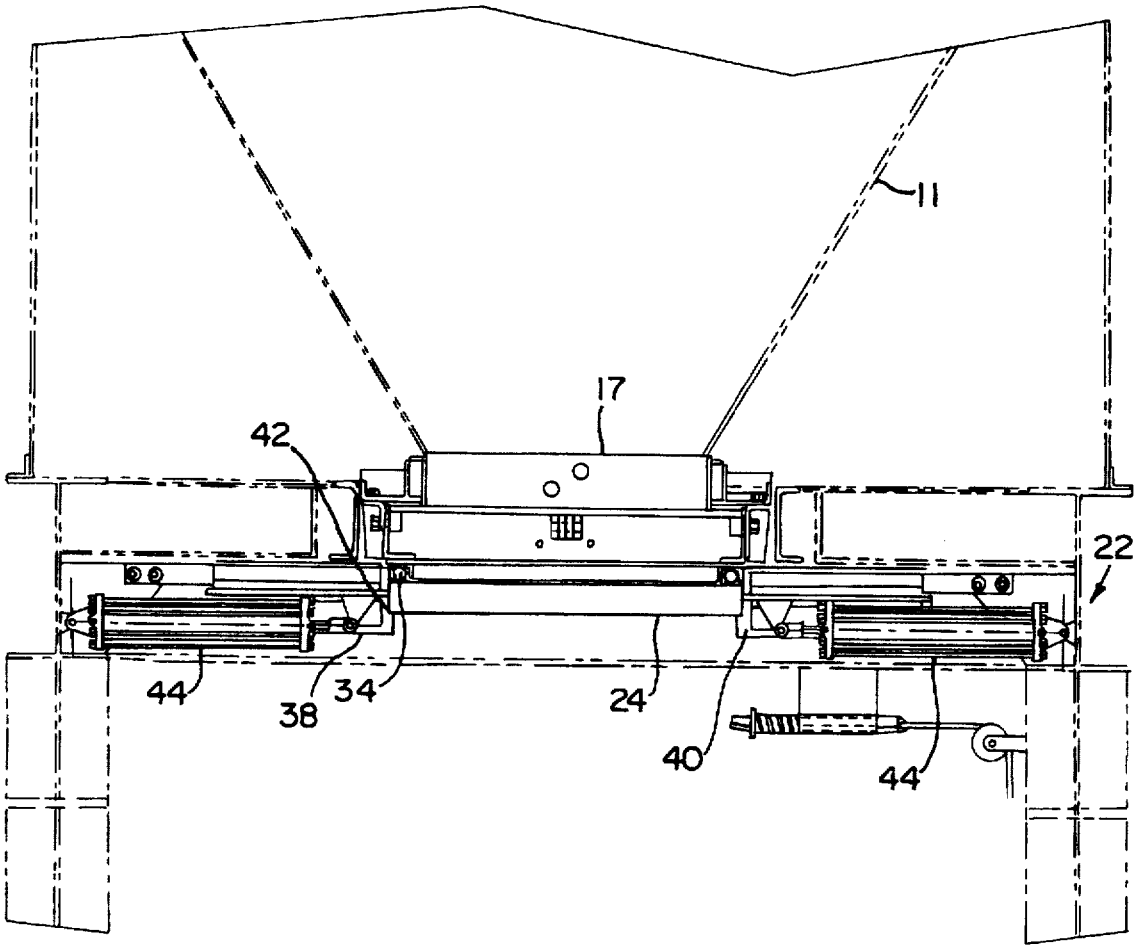
FIG. 5 is another side view of the present invention in the closed position.

A third gate 38 is pneumatically operated. The third gate 38 is a safety gate designed to prevent spillage of the contents of the silo 11 in the event of a failure of the first gate 12. The third gate 38 is not designed to seal the silo. The third gate 38 comprises horizontal flat plates 40 having a lip 42 at their inside edges. (FIG. 5.) The lip 42 of the third gate 38 is positioned below the second gate 24. The third gate 38 is actuated by any conventional means. The third gate is actuated by cylinders 44 which engage the underside of the second gate 24 and force it upward to wedge the second gate 24 against the rubber seal 34 and to hold the second gate 24 in position for an extended time.

In operation, the gate system 10 of the present invention works as follows. During the initial filling of the silo 11 with asphalt mix, the first gate 12 is in the closed position, as in FIG. 1, to prevent asphalt mix from emptying through the discharge end of the silo 11. The third gate 38 is also in the closed position as in FIG. 1. The second gate 24 is in the stored or open position and is secured by safety latch 36. The safety latch 36 must be manually tripped by an operator before the third gate 38 can be actuated and moved into the sealed position.

With the three gates in position, dump trucks or other such units can be loaded by opening the third gate 38, and then opening and closing the first gate 12 as desired to permit asphalt mix to fall through the first gate 12 into the dump truck. After each truck is loaded, the third gate 38 is closed.

When loading is completed, and it is desired to seal the silo 11, the operator will move the third gate 38 to the open position. The operator should then dislodge the safety latch 36 holding the second gate 24 in place. The operator can then rotate the second gate 24 into the sealed or closed position. The lip 42 of the third gate 38 serves as a wedge lock against the second gate 24, which lodges the second gate 24 in position to seal the discharge of the silo.

While the specific embodiments have been illustrated and described, numerous modifications come to mind without significantly departing from the spirit of the invention, and the scope of protection is only limited by the scope of the accompanying claims.

What I claim is:

1. A material storing and dispensing assembly for storing and discharging hot asphalt material, the assembly comprising:

a vertically-extending vessel having a generally cylindrical shape and a top opening for receiving material;

a dispensing cone positioned in the vessel and opposed to the top opening, the dispensing cone having a discharge opening at a distal end for discharging material from the vessel;

a first gate adapted for engagement with the discharge opening between one of an open position for releasing material from the vessel through the discharge opening and a closed position for retaining material within the vessel;

a second gate adapted for effectively sealing the discharge opening in a closed position;

means for sliding the first gate alternatively away from and toward the discharge opening for selectively opening and closing the discharge opening; and means for pivoting the second gate in relation to the first gate and the discharge opening to further selectively open and close the discharge opening.

2. The storing and dispensing assembly of claim 1, further including a gate weldment surrounding the dispensing cone, the weldment having a top side sealed by a series of flanges and a bottom opening for dispensing material therefrom.

3. The storing and dispensing assembly of claim 2 wherein the bottom opening of the gate weldment is in vertical alignment with the discharge opening of the dispensing cone.

4. The storing and dispensing assembly of claim 3 wherein the bottom opening of the gate weldment is adapted for receiving and supporting a sealing element.

5. The storing and dispensing assembly of claim 1 wherein the first gate includes a pair of horizontal flat gates.

6. The storing and dispensing assembly of claim 2 wherein the means for sliding the first gate includes a series of cam rollers structurally mounted within the gate weldment.

7. The storing and dispensing assembly of claim 6 wherein each of the horizontal gates is positioned directly on the series of cam rollers, such that the gates are movable between an open and closed position assisted by the cam rollers.

8. The storing and dispensing assembly of claim 6 wherein the means for sliding the first gate further includes a hydraulic cylinder.

9. The storing and dispensing assembly of claim 2 wherein the first gate is enclosed within the gate weldment.

10. The storing and dispensing assembly of claim 2 wherein the second gate includes a single heavy duty flat gate having opposed ends and a sealing face.

11. The storing and dispensing assembly of claim 10 wherein one edge of the second gate is pivotally attached to a bottom portion of the gate weldment.

12. The storing and dispensing assembly of claim 10 wherein the second gate is pivotable between a vertical storage position and a horizontal sealing position.

13. The storing and dispensing assembly of claim 12 wherein means for pivoting the second gate into sealing position includes rotating the second gate about a horizontal axis and into a horizontal position for engagement by the sealing face of the second gate with the sealing element in the bottom opening of the gate weldment forming an airtight closure of the vessel.

14. The storing and dispensing assembly of claim 12 wherein means for moving the second gate into a stored position includes rotating the second gate into a vertical downward position away from the discharge opening for storage and to enable cleaning of debris from the sealing face.

15. The storing and dispensing assembly of claim 14 wherein the second gate is secured in its downward storage position by a safety latch.

16. The storing and dispensing assembly of claim 2, further comprising a third gate.

17. The storing and dispensing assembly of claim 16 wherein the third gate includes a pair of horizontal flat gates.

18. The storing and dispensing assembly of claim 16 wherein a lip on the inside edge of the third gate is positioned below the second gate, and the third gate slidably moves in a horizontal plane perpendicular to the first gate.

19. The storing and dispensing assembly of claim 18 wherein the third gate further cooperates with an opposed, unattached end of the second gate, securing the second gate in a closed position forming an airtight closure at the bottom opening of the gate weldment for long term storage of material within the vessel.

20. A material storing and dispensing assembly for storing and discharging hot asphalt material, the assembly comprising:

a vertically-extending vessel having a generally cylindrical shape and a top opening for receiving material;

a dispensing cone positioned in the vessel and opposed to the top opening, the dispensing cone having a discharge opening at a distal end for discharging material from the vessel;

a first gate enclosed within a gate weldment, and adapted for engagement with the discharge opening slidable between one of an open position for releasing material from the vessel through the discharge opening and a closed position for retaining material within the vessel;

a second gate having a sealing face adapted for effectively sealing the discharge opening by rotating the second gate from a vertical storage position into a horizontal closed position; and a third gate adapted for further cooperating with the first and second gates, and slidable between one of an open position for releasing material from the vessel and a closed position for retaining material within the vessel.

21. A method of storing and discharging hot asphalt material comprising the steps of:

providing a vertically-extending vessel having a generally cylindrical shape and a top opening for receiving material;

providing a dispensing cone positioned in the vessel and opposed to the top opening, the dispensing cone having a discharge opening at a distal end for discharging material from the vessel;

engaging a first gate with the discharge opening between one of an open position for releasing material from the vessel through the discharge opening and a closed position for retaining material within the vessel;

providing a second gate adapted for effectively sealing the discharge opening in a closed position;

sliding the first gate alternatively away from and toward the discharge opening for selectively opening and closing the discharge opening; and rotating the second gate in relation to the first gate and the discharge opening to further selectively open and close the discharge opening.

22. The method according to claim 21, further including enclosing the first gate within a gate weldment having a top side sealed by a series of flanges and a bottom opening for dispensing material therefrom.

23. The method according to claim 22 wherein sealing the discharge opening includes providing a sealing element within the bottom opening of the gate weldment.

24. The method according to claim 21, including establishing an airtight seal within the vessel by engaging the sealing element with a sealing face of the second gate when the second gate is in a horizontal position.

25. The method according to claim 21 wherein storing the second gate includes pivoting the gate about a horizontal axis and into a vertical position, exposing the sealing face of the second gate.

26. The method according to claim 25 wherein exposing the sealing face of the second gate allows for removing debris from the sealing face.

27. The method according to claim 21 further including providing a third gate.

28. The method according to claim 27 providing the third gate for cooperating with the first and second gates and securing the vessel from leakage.

29. The method of claim 27 providing the third gate for cooperating with and maintaining the second gate member in a sealing position.

* * * * *